United States Patent [19]

Banwell et al.

[11] Patent Number: 5,049,807

[45] Date of Patent: Sep. 17, 1991

[54] ALL-NPN-TRANSISTOR VOLTAGE REGULATOR

[75] Inventors: Thomas C. Banwell, Madison, N.J.; Thomas J. Banwell, Claremont, Calif.

[73] Assignee: Bell Communications Research, Inc., Livingston, N.J.

[21] Appl. No.: 637,175

[22] Filed: Jan. 3, 1991

[51] Int. Cl.[5] ..... G05F 3/20

[52] U.S. Cl. ..... 323/314; 323/316

[58] Field of Search ..... 323/313, 314, 315, 316; 307/296.1, 296.6

[56] References Cited

U.S. PATENT DOCUMENTS

| | | | |
|---|---|---|---|
| 4,628,247 | 12/1986 | Rossetti | 323/314 |
| 4,628,248 | 12/1986 | Birrittella et al. | 323/314 |
| 4,656,415 | 4/1987 | Draxelmayr | 323/314 |
| 4,714,872 | 12/1987 | Traa | 323/907 |
| 4,736,125 | 4/1988 | Yuen | 323/314 |
| 4,737,663 | 4/1988 | Varadarajan | 323/314 |
| 4,816,742 | 3/1989 | Van de Plassche | 323/314 |
| 4,835,455 | 5/1989 | Coddington et al. | 323/314 |

*Primary Examiner*—Peter S. Wong

*Attorney, Agent, or Firm*—Leonard Charles Suchyta

[57] ABSTRACT

A relatively simple voltage regulator comprises a band-gap reference, an error amplifier and a multi-function current mirror. By utilizing only NPN transistors, a high-performance arrangement characterized by good line regulation is achieved.

14 Claims, 1 Drawing Sheet

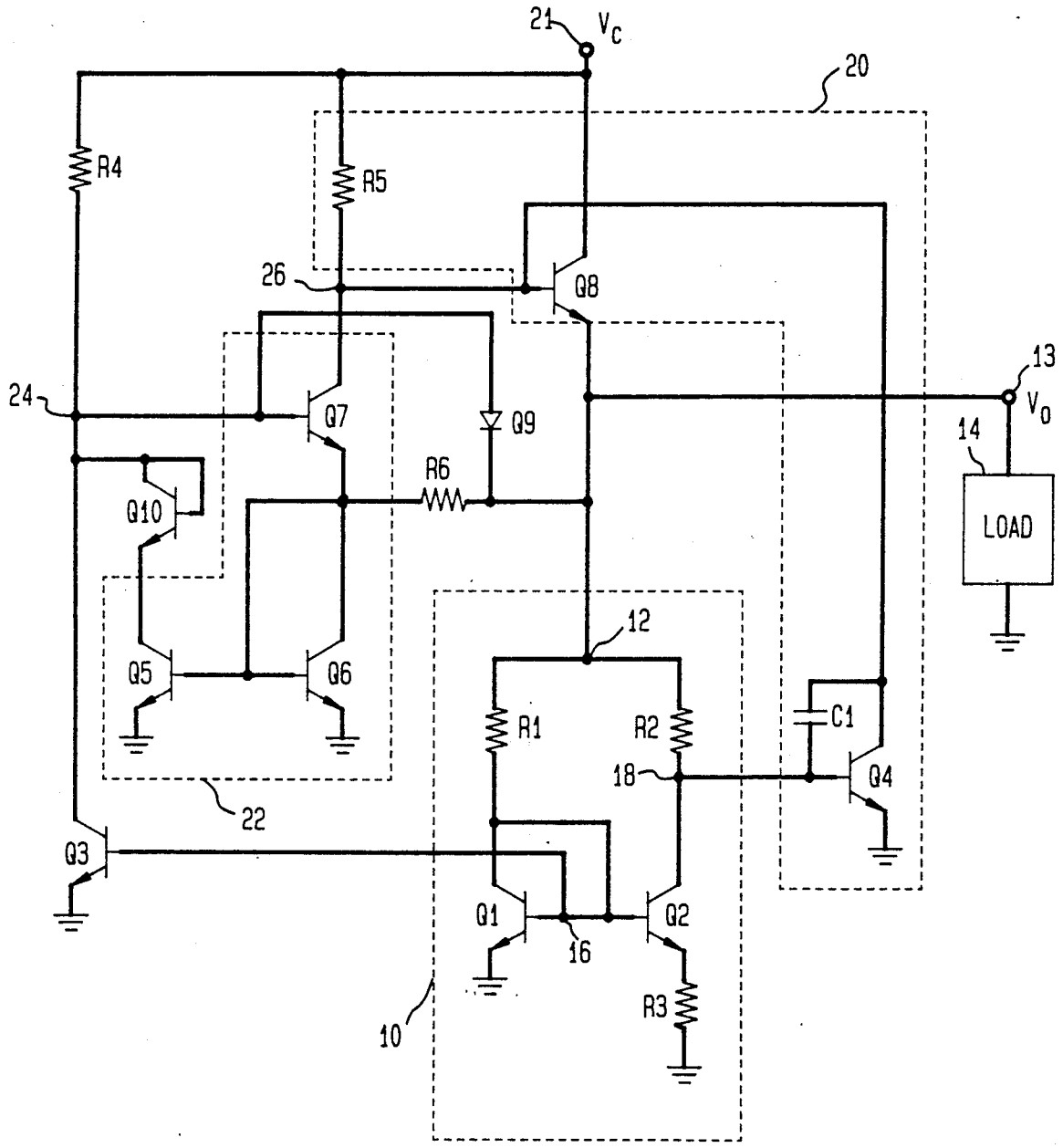
21
$V_C$
20
R4
R5
26
Q8
24
Q7
Q9
13
$V_O$
14
R6
Q10
LOAD
12
Q5
Q6
R1
R2
C1
18
Q4
22
Q3
Q1
Q2
16
R3
10

ALL-NPN-TRANSISTOR VOLTAGE REGULATOR

BACKGROUND OF THE INVENTION

This invention relates to voltage regulators and, more particularly, to a voltage regulator of the type that includes a bandgap reference.

Bandgap voltage references are used extensively in high-performance analog and digital circuits. In these circuits, the regulators serve to establish precise voltage levels at specified internal and/or output node points. By means of such a regulator, the voltage at a node point can be maintained relatively constant even as changes occur in temperature, supply voltage and load current.

Known bandgap voltage regulators comprise a bandgap reference combined with an error amplifier which often contains a current mirror. Some of these combinations which include both PNP- and NPN-type transistors exhibit excellent operating characteristics.

In some technologically advanced processes utilized to fabricate high-speed silicon or heterojunction bipolar devices, it is possible to make excellent NPN transistors. But the PNP transistors made by such processes often exhibit low current gain, low breakdown voltage or poor $V_{BE}$ matching. Hence, for such a fabrication process it is advantageous to design regulators that include only NPN transistors.

Bandgap voltage regulators made of only NPN transistors have been proposed. But priorly known all-NPN-transistors regulators tend to be relatively complicated and to exhibit relatively poor operating characteristics.

Accordingly, efforts have been directed at trying to devise a relatively simple bandgap voltage regulator made of only NPN transistors that would provide better performance than heretofore realized with an all-NPN-transistor design. It was recognized that these efforts if successful would contribute significantly to the realization of high-performance integrated circuits fabricated by high-speed bipolar processes.

SUMMARY OF THE INVENTION

In accordance with the principles of the present invention, a simple bandgap voltage regulator characterized by good operating characteristics comprises a bandgap reference, an error amplifier and a multi-function current mirror all of which include only NPN-type transistors.

In further accord with the invention, the multifunction current mirror itself performs some regulation in response to supply voltage variations. As a result, a relatively simple and stable error amplifier suffices to achieve good overall voltage regulation.

A complete understanding of the present invention of the above and other features and advantages thereof will be apparent from a consideration of the detailed description below taken in conjunction with the accompanying single-figure drawing, which is a circuit diagram of a specific illustrative bandgap voltage regulator made in accordance with the principles of the present invention.

DETAILED DESCRIPTION

The bandgap voltage regulator shown in the drawing comprises a conventional bandgap reference 10 that includes resistors R1, R2 and R3, and NPN transistors Q1 and Q2. Node point 12 of the bandgap reference 10 is connected to an output node point 13 whose voltage with respect to a point of reference potential such as ground is designated $V_o$. A load 14 is connected to the output node point 13.

By way of a specific illustrative example, the values of the resistors R1, R2 and R3 included in the bandgap reference 10 are 948 ohms, 2844 ohms and 365 ohms, respectively. Illustratively, Q1 and Q2 comprise silicon bipolar transistors, with the emitter area of Q2 being about 3.33 times that of Q1. Such a known arrangement functions top monitor the voltage appearing at the output node point 13 and to provide voltages at node points 16 and 18 indicative of any deviation of the voltage $V_o$ at the node point 13 from the bandgap voltage of silicon (extrapolated to absolute zero) which is about 1.22 volts.

When the voltage $V_o$ is +1.22 volts, the voltages at the node points 16 and 18 of the bandgap reference 10 are equal to each other. In that case, no difference signal is provided to the associated circuitry connected to the bandgap reference 10. Consequently, the associated circuitry is not activated to generate a control signal to alter the value of the voltage $V_o$ at the node point 13. The regulator is then in its stable quiescent condition.

On the other hand, when the voltage $V_o$ varies from +1.22 volts due to some external influence (changes in temperature, load current or supply voltage), the voltages at the node points 16 and 18 of the bandgap reference 10 deviate from each other. In that case, a difference signal is provided by the bandgap reference 10 to the associated circuitry. In turn, the associated circuitry generates a compensating control signal that causes the voltage $V_o$ to return to +1.22 volts, as will be described in detail below.

The voltage appearing at the node point 16 of the bandgap reference 10 is applied to the base of NPN transistor Q3. At the same time, the voltage appearing at the node point 18 of the bandgap reference 10 is applied to the base of NPN transistor Q4 which is included in error amplifier 20. Q3 and Q4 are substantially identical transistors (and substantially identical to Q1). Together, Q3 and Q4 constitute in effect a difference amplifier.

Whenever the voltage $V_o$ tends to vary from +1.22 volts, a deference signal is provided by Q3 and Q4. In turn, this difference signal is effect to change the conduction condition of NPN transistor Q8 in the error amplifier 20 in a manner to compensate for the tendency of the voltage $V_o$ to change. As a result, the voltage $V_o$ is thereby maintained at +1.22 volts.

The voltage regulator shown in the drawing also includes a current mirror 22 that functions as a current source when used in conjunction with resistors R4 and R5. The mirror 22 comprises NPN transistors Q5, Q6 and Q7. Illustratively, the transistors Q5, Q6 and Q7 are substantially identical to each other. A diode-connected transistor Q10 is connected between the base of Q7 and the collector of Q5 in the current mirror 22. Illustratively, transistor Q10 is substantially identical to Q5.

The aforementioned error amplifier 20 that comprises the transistors Q4 and Q8 also includes a resistor R5. Further, a capacitor C is connected between the base and collector of Q4. The capacitor C provides dominant-pole compensation with a reasonable value of capacitance. Illustratively, the value of R5 is 3000 ohms and the value of C is approximately one picofarad.

Resistors R4 and R6 and diode Q9 are connected to the current mirror 22. The value of R4 is the same as that of R5. Thus, for the particular example specified herein, R4 also has a value of 3000 ohms. Illustratively, R6 also has the same value, namely, 3000 ohms. By way of example, diode Q9 comprises an NPN transistor connected as a diode. Together with the basic current mirror 22, the additional components R4, R6, Q9, Q10 and Q3 constitute a unique multi-function current mirror.

A supply voltage $V_c$ is connected to node point 21 shown in the drawing. Illustratively, the value of the supply voltage $V_c$ is approximately +5.0 volts.

To understand the mode of operation of the regulator shown in the drawing, assume, for example, that the output voltage $V_o$ appearing at the node point 13 tends, due to external influences, to increase to a more positive value (above +1.22 volts). As $V_o$ increases, the voltage at node point 18 of the bandgap reference 10 also increases to a more positive value. To a lesser extent, the voltage at node point 16 also increases to a more positive value to the increase in $V_o$. As the voltage at node point 18 increases, Q4 conducts more. In turn, this reduces the drive to Q8 in the error amplifier 20, which in effect causes $V_o$ to decrease. At the same time, the increase in voltage at node point 16 causes Q3 to conduct more which takes current from the current mirror 22. In turn, this allows more of the current flowing through R5 to be available to drive Q8. In practice, the net effect on Q8 of the increased current through Q3 and Q4 is to control Q8 to assume a conduction condition that controls $V_o$ to return to the aforespecified value of +1.22 volts. At that value of output voltage, the voltages at the node points 16 and 18 are again the same, and the regulators is again in its quiescent stable state.

As described above, Q3 and Q4 function as a difference amplifier responsive to the voltages at the node points 16 and 18. As those voltages become unequal due to a deviation in $V_o$ from +1.22 volts, the currents through Q3 and Q4 respectively change. In turn, due to the action of the current mirror 22, the net single-ended drive to Q8 is thereby changed to establish a new operating point for Q8. The new operating point is designed to supply sufficiently more or less current to the load 14 to restore $V_o$ to 1.22 volts.

The resistor R4 connected to the current mirror 22 functions in effect therewith as a pre-regulator for the error amplifier 20. In particular, the drive to Q8 is thereby maintained relatively constant even as the supply voltage $V_c$ changes due to external influences. As a result, the requirements imposed on the error amplifier 20 are lessened relative to what they would e if an increase in $V_c$ caused the base drive to Q8 to increase. Hence, a relatively simple circuit characterized by stable operating characteristics suffices as the error amplifier.

Assume, for example, that $V_c$ increase to a value above +5.0 volts. This causes the currents through the equal-valued resistors R4 and R5 to increase. This increase in current is in effect absorbed by the current mirror 22. The currents through R4 and R5 were and remain equal to each other. The voltage at node point 24 at the bottom of R4 is constrained to remain at $2V_{BE}$. Therefore the voltage at node point 26 at the bottom of R5 will also remain at $2V_{BE}$ plus the voltage drop across R5 produced by the difference in collector currents from Q3 and Q4 and the current in R6. Consequently, the drive to Q8 will not be increased as $V_c$ increases.

Even though the base drive to Q8 remains substantially unchanged as $V_c$ increases, as described above, the collector-to-emitter current of Q8 will increase as a result of the increase in $V_c$. In turn, $V_o$ will tend to be thereby increased. But as $V_o$ increases, Q3 and Q4 apply a difference signal to Q8 to decrease it collector-to-emitter current, which thereby decreases $V_o$ in a compensating way, as described earlier above.

The collector current of Q7 in current source 22 should ideally be equal to the difference between the current through R4 and Q3 collector current. However, this condition will not precisely occur with practical transistors unless the collector-emitter voltage of Q5 equals the collector-emitter voltage of Q6. Diode Q10 is therefore added to an otherwise conventional current mirror 22 to reduce the collector voltage of Q5 below the voltage at node 24 by $V_{BE}$. The action of Q10 therefore maintains the collector-emitter voltage of Q5 at $V_{BE}$, which is nearly the same as that of Q6 by virtue of the collector-base connection of Q6.

The resistor R6 connected to the current mirror 22 serves to shift $V_o$ up to the desired value of +1.22 volts. Without R6, $V_o$ in this particular regulator would be about one-half volt lower than the desired value when the voltage at node points 16 and 18 are equal. The drop across R6 added to $V_{BE}$ provides a value of about +1.22 volts for $V_o$ when the voltage at node points 16 and 18 are equal. As a result, the requirements imposed on the error amplifier 20 are lessened.

Without R6, the lower-than-desired value for $V_o$ could in principle be pulled up to +1.22 volts by the aforedescribed compensating action of the error amplifier 20. But in practice such a requirement imposed on the error amplifier would cause $V_o$ to shift away from the desired +1.22 volts. To avoid that possibility, additional stages and complexity would have to be added to the amplifier to achieve reliable performance. With R6, a relatively simple amplifier suffices to perform error compensation.

The regulator shown in the drawing is designed to have a single stable operating point. The diode Q9 insures that such a point will initially be achieved. During start-up, under heavy loads and at high temperatures, without Q9, the desired stable operating point might not be achieved. Such an undesired condition would occur if $V_o$ were initially too low (for example below about 0.7 volts). For such a low value of $V_o$, the error amplifier by itself would not in practice be capable of pulling $V_o$ up to the desired value of +1.22 volts.

During start-up, for values of $V_o$ below 0.7 volts, the diode Q9 is rendered conductive. This causes current to be diverted from the node point 24. Due to the action of the current mirror 22, this causes correspondingly more current to be available at the node point 26 which in turn causes Q8 to conduct more. As a result, $V_o$ is thereby pulled up to a value of about 0.8 volts. At that point, the error amplifier 20 is capable of completing the pull-up of $V_o$ to achieve the final desired value of +1.22 volts. The diode Q9 then ceases to conduct.

The simple regulator depicted in the drawing is characterized by a relatively high degree of circuit symmetry (see, for example, Q3 and Q4, R4 and R5). In turn, this assures relatively good temperature stability of the regulator. Moreover, in practice, the line regulation of the specific illustrative regulator described herein is relatively good, being, for example, about 0.7 millivolts per volt. In other words, $V_o$ changes by only 0.7 millivolts when $V_c$ changes by one volt, for example, when $V_c$ is externally varied from an initial value of 4.5 volts to a final value of 5.5 volts.

Finally, it is to be understood that the specific arrangement described herein is only illustrative of the application of the principles of the present invention. In accordance with these principles, numerous alternatives and modifications may easily be made by those skilled in the art without departing from the spirit and scope of the invention.

What is claimed is:

1. A voltage regulator comprising a reference node point, a bandgap reference connected to said reference node point, said bandgap reference having two internal node points whose voltages are indicative of whether or not the voltage of said reference node point is at a specified value, a supply voltage source, a current mirror, two equal-valued resistors connected in parallel between said supply voltage source and said current mirror, a first transistor having its collector connected to said supply voltage source, its emitter connected to said reference node point and its base connected to a point between one of said resistors and said current mirror, a second transistor having the base connected to one of the internal node points of said bandgap reference, its emitter connected to a point of reference potential and its collector connected to a point between the other one of said resistors and said current mirror, and a third transistor having its base connected to the other one of the internal node points of said bandgap reference, its emitter connected to said point of reference potential and its collector connected to the base of said first transistor, whereby a deviation of the voltage at said reference node point from said specified value causes a voltage difference to occur between said internal node points which causes a control signal to be applied to the base of said first transistor to cause its conduction to change to restore the voltage at said reference node point to said specified value.

2. A regulator as in claim 1 wherein each of said first, second and third transistors is of the NPN type.

3. A regulator as in claim 2 wherein a capacitor is connected between the collector and base of said third transistor.

4. A regulator as in claim 3 wherein said bandgap reference and said current mirror each include transistors only of the NPN type.

5. A regulator as in claim 4 further including means connected between said current mirror and said reference mode point for augmenting the voltage appearing at said reference node point.

6. A regulator as in claim 5 wherein said means for augmenting comprises a resistor.

7. A regulator as in claim 6 further including means responsive to the voltage initially appearing at said reference node point being lower than a set value below said specified value for temporarily augmenting the base drive to said first transistor.

8. A regulator as in claim 7 wherein said means for augmenting comprises a diode connected between said reference node point and a point between said other one of said resistors and said current mirror.

9. A regulator as in claim 8 wherein said other one of resistors is connected to said current mirror via two parallel paths, one of which paths is a direct electrical connection to said current mirror and the other of which paths includes another diode.

10. A regulator as in claim 9 wherein said supply voltage source is adapted to supply a positive voltage.

11. A regulator as in claim 10 wherein the specified value of voltage at said reference node point is approximately +1.22 volts.

12. A regulator as in claim 11 wherein said reference node point is adapted to be connected to a load.

13. A regulator as in claim 12 wherein said supply voltage source is adapted to supply a voltage of approximately +5.0 volts.

14. A regulator as in claim 13 wherein the resistor that augments the voltage appearing at said reference node point is adapted to develop thereacross a voltage of approximately 0.5 volts.

* * * * *